US007640671B1

(12) United States Patent
Tu

(10) Patent No.: US 7,640,671 B1
(45) Date of Patent: Jan. 5, 2010

(54) MEASURING COMPASS

(76) Inventor: Yu-Ming Tu, No. 22, Lane 291, Yu Nung Road, East District, Tainan City (TW)

( * ) Notice: Subject to any disclaimer, the term of this patent is extended or adjusted under 35 U.S.C. 154(b) by 0 days.

(21) Appl. No.: 12/167,262

(22) Filed: Jul. 3, 2008

(51) Int. Cl.
*B43L 9/02* (2006.01)

(52) U.S. Cl. ..... 33/27.02; D19/38

(58) Field of Classification Search ... 33/27.01–27.031, 33/27.033, 30.1, 32.1–32.3, 18.1, 18.2, 666, 33/669, 670, 678, 558.01, 558.02, 558.2–558.5; D19/38, 41–43, 54–58
See application file for complete search history.

(56) References Cited

U.S. PATENT DOCUMENTS

| | | | | | |
|---|---|---|---|---|---|
| 459,519 | A | * | 9/1891 | Coolins | 33/27.02 |
| 1,292,086 | A | * | 1/1919 | Schenck | 33/558.3 |
| 1,674,726 | A | * | 6/1928 | Keaney | 33/27.02 |
| 2,017,737 | A | * | 10/1935 | Smith | 33/27.02 |
| 2,041,299 | A | * | 5/1936 | Neumayer | 33/27.02 |
| 2,543,138 | A | * | 2/1951 | Vaughan | 33/558.5 |
| 4,106,200 | A | * | 8/1978 | Maxwell | 33/27.02 |
| 4,163,322 | A | * | 8/1979 | Partes | 33/27.02 |
| 4,815,881 | A | * | 3/1989 | Chern | 401/52 |
| 6,871,406 | B1 | * | 3/2005 | Elia et al. | 33/27.02 |

FOREIGN PATENT DOCUMENTS

| | | | |
|---|---|---|---|
| FR | 2657296 | A1 * | 7/1991 |
| GB | 2106839 | A * | 4/1983 |

* cited by examiner

*Primary Examiner*—Amy Cohen Johnson
(74) *Attorney, Agent, or Firm*—Leong C. Lei

(57) ABSTRACT

A measuring compass is disclosed. The compass comprises a marking leg, a pegging leg which symmetrically form into a shape of a pencil. The upper end of the pegging leg and the marking leg is a center plate or gear module, and the bottom end is a protective cover for protecting the marking leg and the pegging leg. When the compass is not in use, the marking leg and the pegging leg are closed to each other and the protective cover caps the legs. The compass can be inserted to a pocket.

2 Claims, 7 Drawing Sheets

MEASURING COMPASS

BACKGROUND OF THE INVENTION (a) Technical Field of the Invention

The present invention relates to a measuring compass, and in particular, a measuring compass having a shape of a pencil and a protective cover to mount a marking leg and a pegging leg of the compass.

(b) Description of the Prior Art

FIG. 1 shows a conventional measuring compass 1 having an upper end being the compass head 10 which is pivotally mounted to a pegging leg 11 and a marking leg 12. The compass head 10 could adjust the distance between the pegging leg 11 and the marking leg 12. The bottom end of the marking leg 12 is inserted with a pencil lead grip 13 which is a screw bolt 14 passing through a screw nut 140 such that the grip 13 is fastened. The bottom end of the grip 13 is fastened with a pencil lead 130. A positioning peg 110 is protruded from the bottom end of the pegging leg 11, and is used for positioning.

The top end of the compass head 10 is a handle 101. When in application, the radius of a circle is adjusted and the positioning peg 110 is positioned as the center point of the circle. The rotation of the handle 101 causes the marking leg 12 to draw a circle. The pencil lead 130 draws out the circular arc. However, the above-described measuring compass has the following drawbacks:

Conventional measuring compass always have the shape which could be easily identified as compass, and a box is needed to keep the compass. Accordingly, the compass is not conveniently carried from place to place. The pencil leads 130 used in conventional compass are always kept in another place. Therefore, when the pencil lead 130 is to be replaced, much time is wasted to look for the pencil lead.

In view of the above, the inventor has invented a measuring compass which could mitigate the above drawbacks.

SUMMARY OF THE INVENTION

The primary purpose of the present invention is to provide a measuring compass comprising a marking leg and a pegging leg pivotally mounted at the compass head, the marking leg and the pegging leg being engageable connected by a center plate or a gear module, characterized in that the pegging leg and the marking leg are symmetrical, and when the pegging leg and the marking leg are combined together, the compass has the shape of a pencil, the bottom section of the pegging leg and the marking leg is provided with a gripping plate facilitating the gripping of a pencil lead and a positioning peg, and the lower end of the compass is provided with a protective cover which mounts the pegging leg and the marking leg preventing the legs from swinging.

Still an object of the present invention to provide a measuring compass, wherein the protective cover is provided internally a plurality of engaging stripes.

Yet a further object of the present invention is to provide a measuring compass, wherein the top end of the compass is screwedly mounted a handle forming into a cavity within the handle.

Still yet another object of the present invention is to provide a measuring compass, wherein the inner surfaces of the pegging leg and the marking leg corresponding to each other are formed into a recess having a covering plate allowing opening and closing of the recess.

A yet another object of the present invention is to provide a measuring compass, wherein the bottom end of the gripping plate is provided with a clipping slot with threads.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
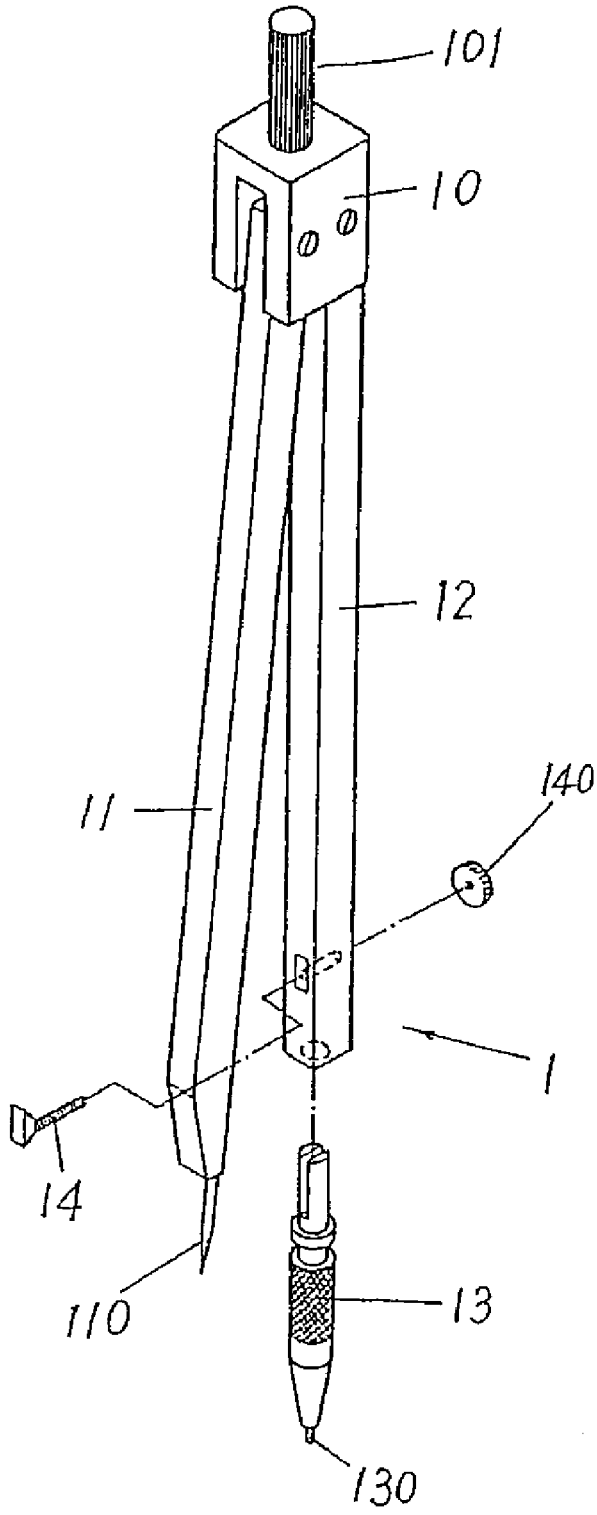
FIG. 1 PRIOR ART
FIG. 1 is a perspective view of a conventional measuring compass.
Figure 2:
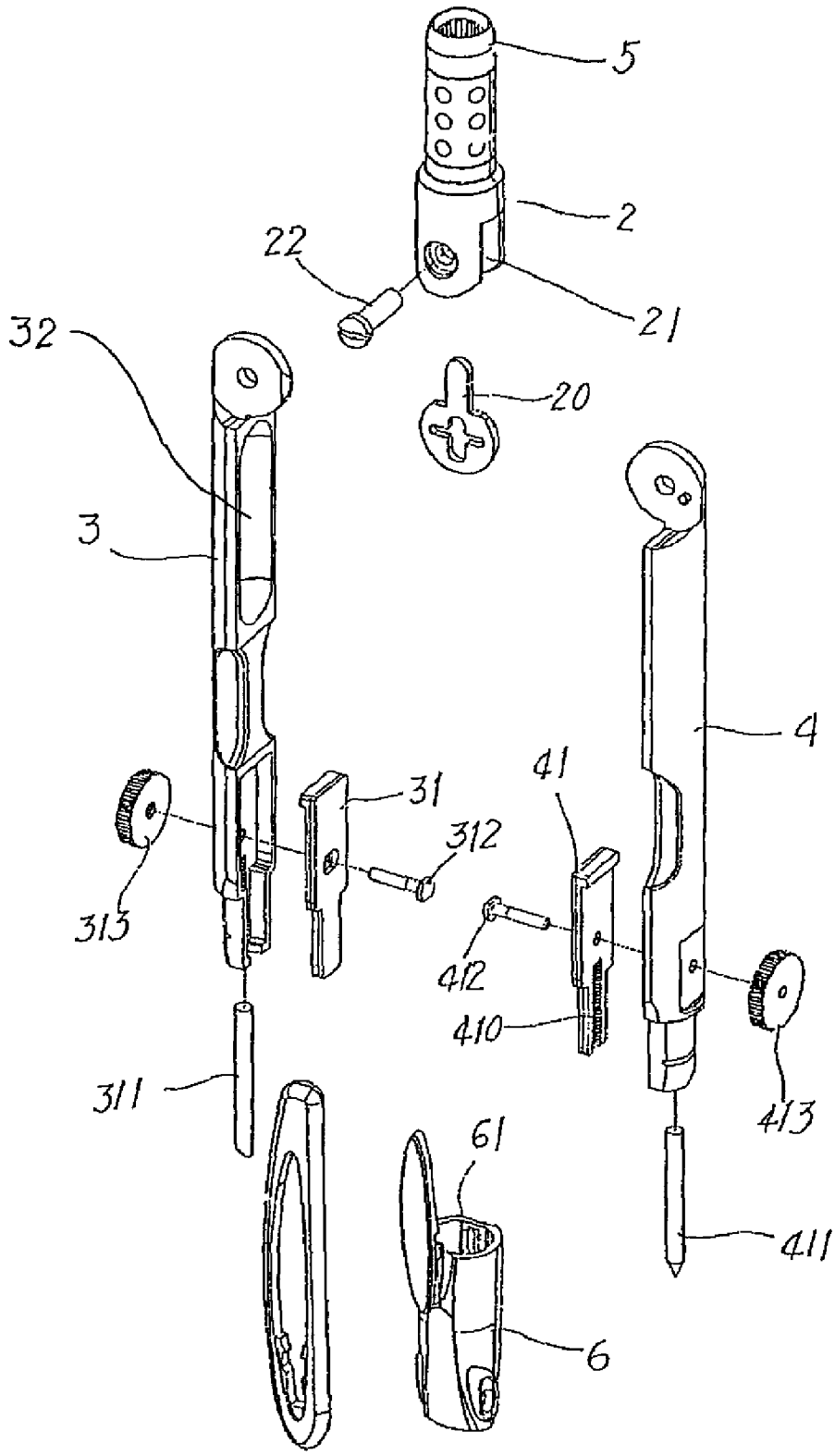
FIG. 2 is a perspective exploded view of the measuring compass of the present invention.

Referring to FIG. 2, there is shown a perspective exploded view of the measuring compass in accordance with the present invention. The measuring compass of the present invention comprises a compass head 2, a marking leg 3, a pegging leg 4, a handle 5 and a protective cover 6. The compass head 2 is provided with a recess 21 adapted for receiving the upper ends of the marking leg 3 and the pegging leg 4, and the center of the compass head 2 is provided with a center plate 20, which is then screwed to the screw bolt 22 such that the marking leg 3 and the pegging leg 4 are pivotally connected with the compass head 2, which allows a swinging action.

Figure 3:
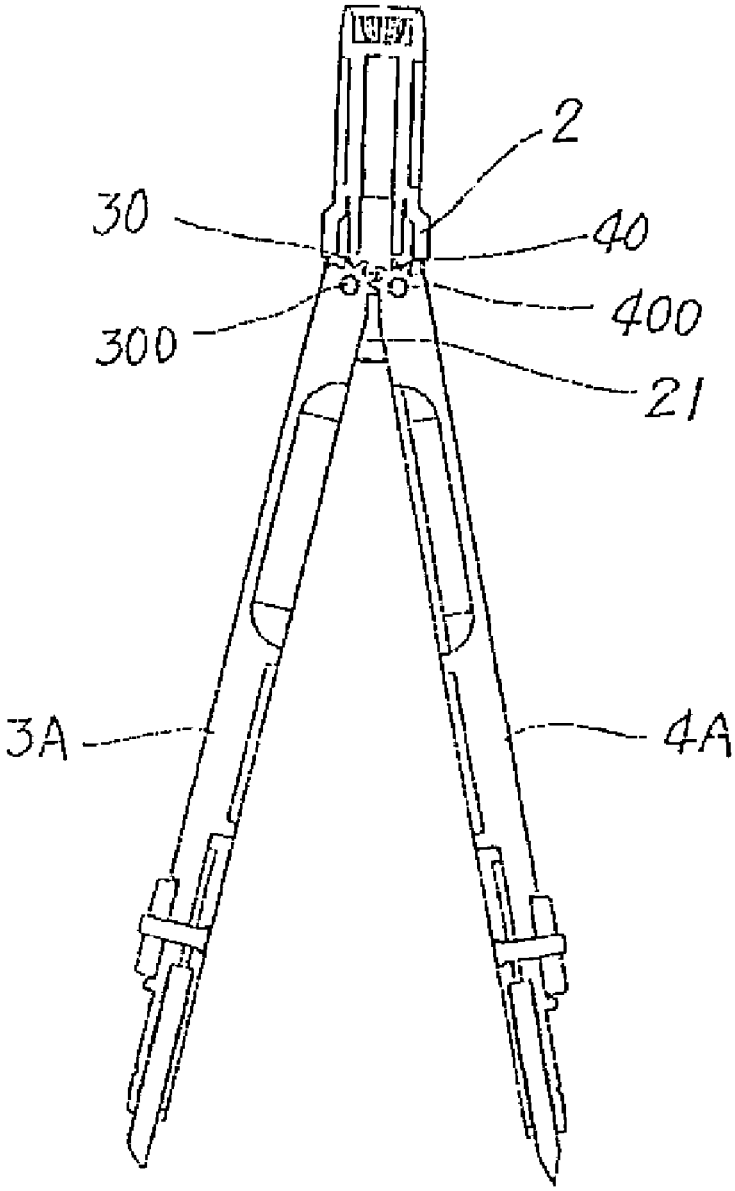
FIG. 3 is a schematic view showing the gear module in accordance with the present invention.

As shown in FIG. 3, the marking leg 3A and the pegging leg 4A are provided at the top with teeth 30, 40, and are located within the recess 21 of the compass head 2. The teeth 30, 40 are provided with positioning holes 300, 400, which allow the fastening using a screw bolt. When the marking leg 3A and the pegging leg 4A are pulled apart, the teeth 30 and 40 at the top end are engageably moved. The unique features of the present invention are that the marking leg 3 and the pegging leg 4 are symmetrical. As shown in FIG. 2, when the marking leg 3A and the pegging leg 4A are closed to form into the shape of a pencil (refer to FIG. 4), and the top end of the compass head 2 has a fixing rod which could screwedly mount the handle 5, which has a similar shape of the compass head 2, and the marking leg 3 and the pegging leg 4 are respectively provided at the bottom end with gripping plates 31, 41, and the lower ends of the gripping plates 31, 41 are formed threaded slots 310, 410. When the pencil lead 311 and the positioning peg 411 are gripped, screw bolts 312, 412 and screw nuts 313, 413 are used for fastening. The fastening process is simple and conveniently. The shape of the protective cover 6 is made into a pencil shape, and the interior of the protective cover 6 is provided with a plurality of engaging stripes 61. When the protective cover 6 is used to mount the marking leg 3 and the pegging leg 4, the marking leg 3 and the pegging leg 4 are engaged, which prevent the legs 3, 4 from swinging.

Figure 4:
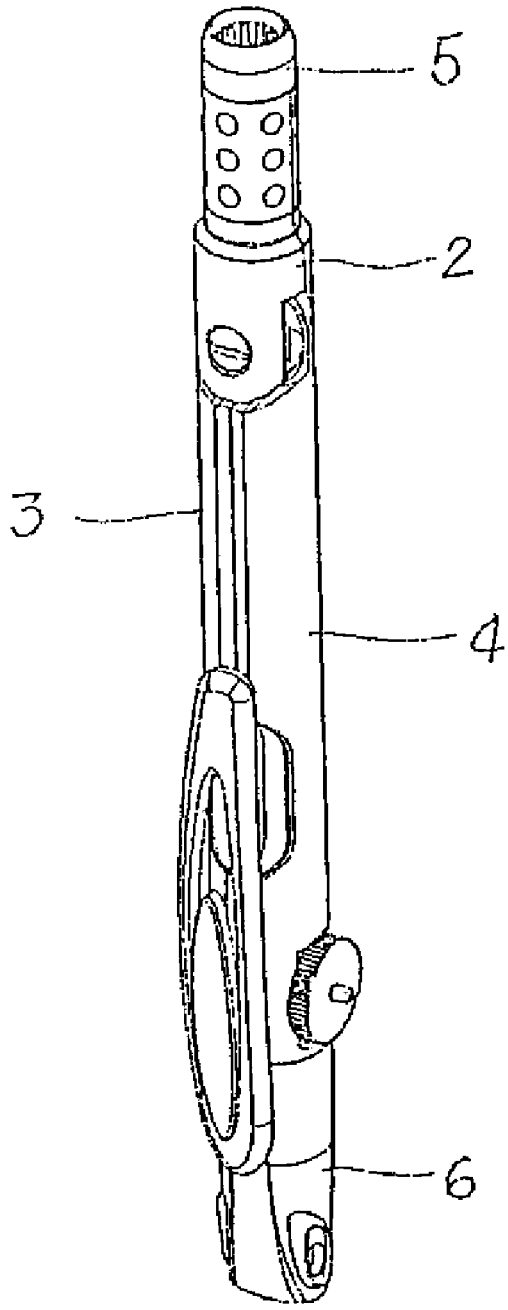
FIG. 4 is a perspective view of the present invention.

Referring to FIG. 4, there is shown how the legs 3, 4 are used in storing. The pivotal end of the compass head 2 is pivotally connected to the center plate 20 or teeth 30, 40, which allows effective swinging, and the marking leg 3 and the pegging leg 4 are closed, and in combination with the handle 5 to the device to form the shape of a pencil. The shape can be oval shape, circular shape, triangular and polygonal, or other quadrilateral irregular shapes. In accordance with the present invention, the marking leg 3 and the pegging leg 4 are symmetrically mounted in combination with the protective cover 6, which can be capped onto the marking leg 3 and the pegging leg 4 of the compass, thereby enabling the compass to be inserted into the pocket, which is conveniently carried along.

Figure 5:
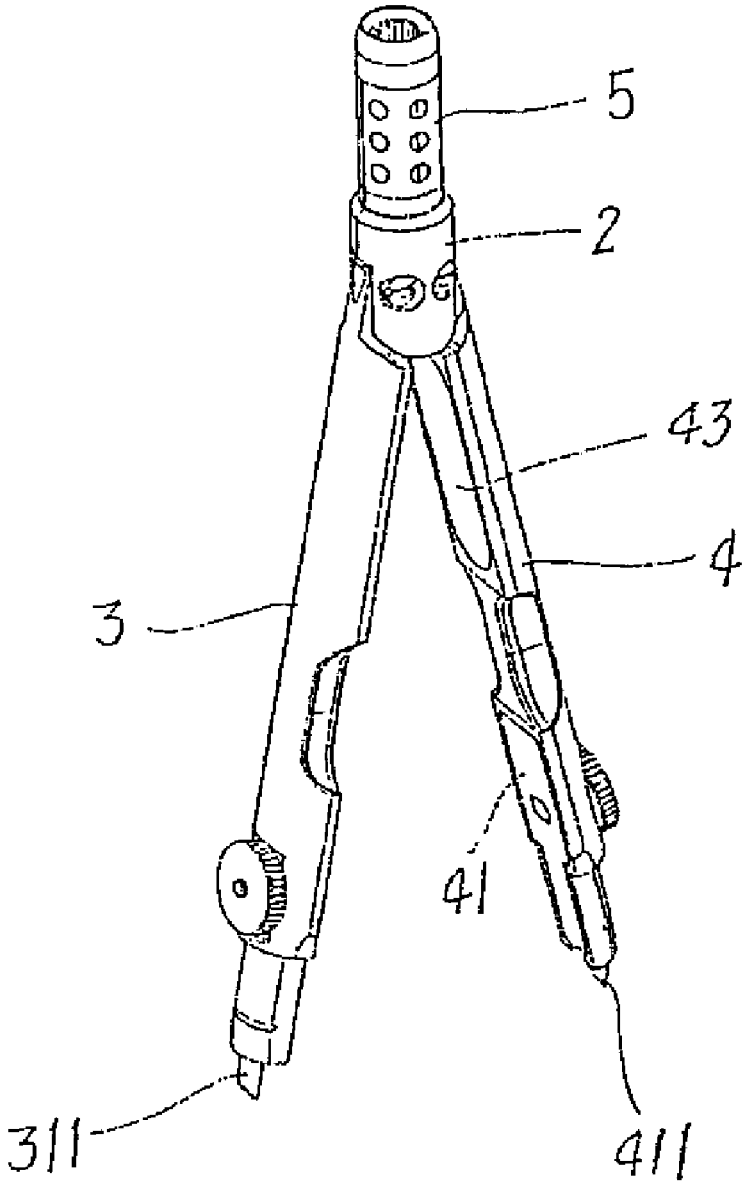
FIG. 5 is a schematic view showing the application of the compass of the present invention.

In application of the measuring compass, as shown in FIG. 5, the compass is withdrawn from pocket similar to using a pen or pencil. The protective cover 6 is withdrawn, such that the marking leg 3 and the pegging leg 4 are not engaged or restricted. At this point of time, the distance between the marking leg 3 and the pegging leg 4 are adjusted, and the positioning peg 411 of the pegging leg 4 are placed at a positioning point. The handle 5 is held and rotated, and the pencil lead 311 will draw a required circle or arc. The pencil lead 311 is being fastened using the gripping plate 31 together with the screw bolt 312 and the screw nut 313, and the length of the gripping plate can be adjusted or replaced. The positioning peg 411 is adjusted using the gripping plate 41 and the screw bolt 412 and the screw nut 413, allowing the storage of pencil lead 31. Thus, the misplacing of pencil lead 31 will not occur. The interior of the handle 5 is provided with a cavity 50 for holding a plurality of pencil lead 311 (as shown in FIG. 6)

Figure 6:
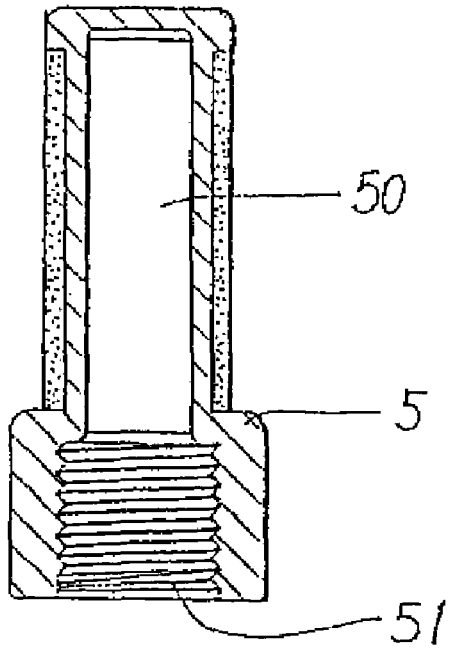
FIG. 6 is a schematic view showing the pencil lead being stored in accordance with the present invention.
Figure 6:
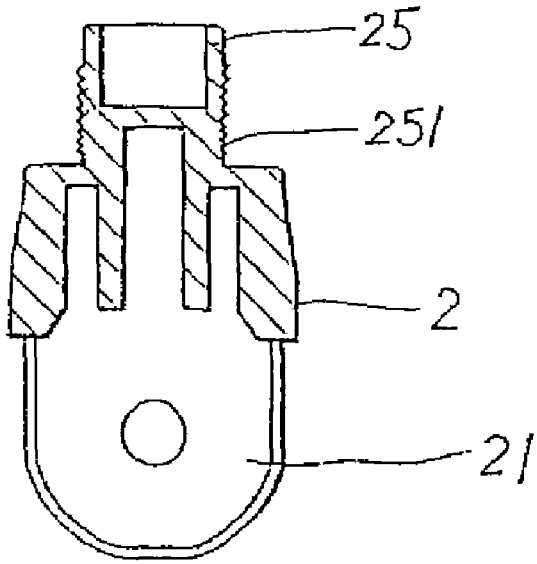

As shown in FIG. 6, the top end of the compass head 2 is formed into a fixing pillar 25, having a threaded section 251, and the handle 5 has internal threads 51 which is screwed with the fixing pillar 25. The interior of the handle 5 is a cavity 50 which can hold a plurality of pencil leads 311, which can be carried along with the compass and facilitates the replacement of pencil lead.

Figure 7:
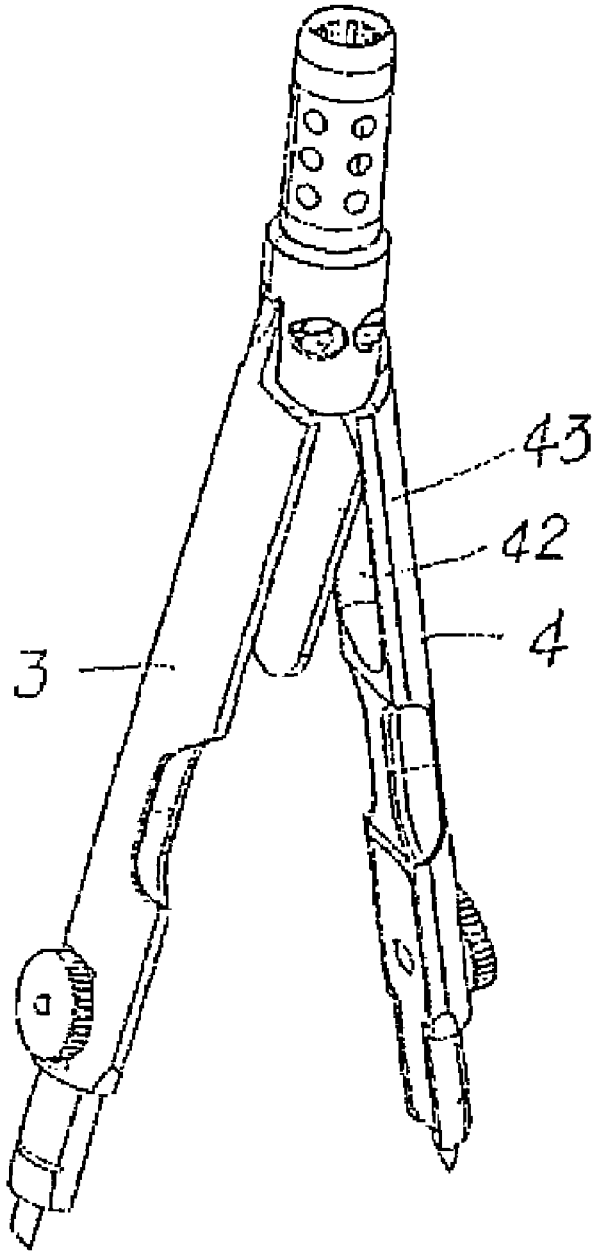
FIG. 7 is a schematic view showing the recess and the covering plate in accordance with the present invention.

Referring to FIG. 7, the surfaces corresponding to each other of the marking leg 3 and the pegging let 4 are provided with recess 32, 42 together with a corresponding covering plate 43. The recess 32, 42 can be used to hold the pencil lead 311 or other small components such as the positioning peg 411.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A measuring compass comprising:

a compass head having a lower end formed with a recess and an upper end formed with external threads;

a marking leg having an upper end fitted in said recess and pivotally connected with said lower end of said compass head, said marking leg having a recess for receiving pencil leads and a covering plate engaged with said recess of said marking leg, said upper end of said marking leg being provided with a plurality of teeth, said marking leg having a lower end engaged with a gripping plate between which is fitted a pencil lead;

a pegging leg having an upper end fitted in said recess and pivotally connected with said lower end of said compass head, said pegging leg having a recess for receiving pencil leads and a covering plate engaged with said recess of said pegging leg, said upper end of said pegging leg being provided with a plurality of teeth rotatably engaged with said teeth of said marking leg, said pegging leg having a lower end engaged with a gripping plate between which is fitted a positioning peg;

a handle having an interior formed with a cavity for receiving pencil leads and an open bottom, said open bottom having internal threads engageable with said external threads of said compass head; and a protective cover adapted to enclose said lower ends of said marking and pegging legs.

2. The measuring compass as claimed in claim 1, wherein said protective cover is provided internally with a plurality of engaging stripes.

* * * * *